US007370705B2

(12) United States Patent
Jones et al.

(10) Patent No.: US 7,370,705 B2
(45) Date of Patent: May 13, 2008

(54) MULTIPLE ZONE DOWNHOLE INTELLIGENT FLOW CONTROL VALVE SYSTEM AND METHOD FOR CONTROLLING COMMINGLING OF FLOWS FROM MULTIPLE ZONES

(75) Inventors: Kevin Jones, Humble, TX (US); Greg Olin, Missouri City, TX (US); Sebastian Wolters, Kingwood, TX (US); Jesse Constantine, Kingwood, TX (US); David Bilberry, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 626 days.

(21) Appl. No.: 10/420,303

(22) Filed: Apr. 22, 2003

(65) Prior Publication Data

US 2003/0226665 A1 Dec. 11, 2003

Related U.S. Application Data

(60) Provisional application No. 60/378,208, filed on May 6, 2002.

(51) Int. Cl.
*E21B 43/12* (2006.01)
*E21B 34/06* (2006.01)

(52) U.S. Cl. ..... 166/320; 166/250.15; 166/386

(58) Field of Classification Search ..... 166/250.01, 166/250.15, 369, 373, 381, 386, 53, 313, 166/236, 242.1, 319, 320, 332.1, 334.4
See application file for complete search history.

(56) References Cited

U.S. PATENT DOCUMENTS 2,905,099 A 9/1959 Turner ..... 103/179
2,963,089 A 12/1960 Sizer ..... 166/72
3,282,341 A 11/1966 Hodges ..... 166/114
4,651,969 A 3/1987 Dowdall ..... 251/14
4,771,807 A 9/1988 Karani ..... 137/553
4,896,722 A * 1/1990 Upchurch ..... 166/250.15
5,147,559 A * 9/1992 Brophey et al. ..... 210/744
5,355,960 A * 10/1994 Schultz et al. ..... 166/374
5,547,029 A * 8/1996 Rubbo et al. ..... 166/375
5,597,042 A * 1/1997 Tubel et al. ..... 166/250.01
6,179,052 B1 1/2001 Purkis et al. ..... 166/53
6,227,298 B1 * 5/2001 Patel ..... 166/321

(Continued)

OTHER PUBLICATIONS

PCT International Search Report.

*Primary Examiner*—Jennifer H. Gay
(74) *Attorney, Agent, or Firm*—Cantor Colburn LLP

(57) ABSTRACT

A production control system having a series of nested tubular members including at least one axial flow channel and at least two annular flow channels. At least one valve configured and positioned to control flow from each flow channel is provided.

A production apparatus having a series of nested tubulars connected to one another such that at least an axial flow channel and at least two annular flow channels are formed. A valve is associated with each flow channel and is configured to independently control flow from each flow channels. A method for controlling commingling of flows from multiple zones. The method includes containing flows from different zones to individual concentric flow channels in a nested tubular arrangement and selectively commingling one or more of the flows by setting at least one valve associated with each channel to a closed position or one of an infinite number of flow positions.

12 Claims, 1 Drawing Sheet

U.S. PATENT DOCUMENTS 6,302,216 B1 * 10/2001 Patel ..... 166/375
6,470,970 B1 10/2002 Purkis et al. ..... 166/374
6,561,277 B2 * 5/2003 Algeroy et al. ..... 166/373
6,575,237 B2 6/2003 Purkis et al. ..... 166/72
2002/0050358 A1 * 5/2002 Algeroy et al. ..... 166/313
2003/0221834 A1 * 12/2003 Hess et al. ..... 166/313
2004/0173350 A1 * 9/2004 Wetzel et al. ..... 166/253.1

* cited by examiner

MULTIPLE ZONE DOWNHOLE INTELLIGENT FLOW CONTROL VALVE SYSTEM AND METHOD FOR CONTROLLING COMMINGLING OF FLOWS FROM MULTIPLE ZONES

CROSS REFERENCE TO RELATED APPLICATIONS

This application claims the benefit of an earlier filing date from U.S. Provisional Application Ser. No. 60/378,208 filed May 6, 2002, the entire disclosure of which is incorporated herein by reference.

BACKGROUND

In the beginnings of drilling for oil and other hydrocarbon resources, a relatively vertical well was drilled into the earth's surface and whatever pockets of fluid were encountered would be produced at the surface. This includes different phases of desired hydrocarbons, water, etc. Many times only a single component of the formation reserve is desired to be produced and it is costly and time consuming to separate the produced fluids into the constituent components thereof once they have been intermingled. In order to alleviate the need for separation, the art has learned to separate zones of production into smaller sections. This can be done in a number of ways including by gravel packing and packing off different sections. After a gravel packing operation, fluids can only enter the wellbore through a holed base pipe in a particular section where those fluids were produced from the formation. One of the problems associated with controlling these individual zones is that the gravel pack (or other downhole arrangement) tends to restrict the I.D. of the tubing string making it difficult to install a valve at that location. Installation of valves uphole of the gravel pack has been limited to two for a significant period of time as there has been no way to control more zones through valves located uphole of the gravel pack.

SUMMARY

Disclosed here is a production control system having a series of nested tubular members including at least one axial flow channel and at least two annular flow channels.

At least one valve configured and positioned to control flow from each flow channel is provided.

Further disclosed herein is a production apparatus having a series of nested tubulars connected to one another such that at least an axial flow channel and at least two annular flow channels are formed.

A valve is associated with each of the flow channels and is configured and positioned to independently control flow from each of the flow channels.

Further disclosed herein is a method for controlling commingling of flows from multiple zones. The method includes physically containing flows from different zones to individual concentric flow channels in a nested tubular arrangement and selectively commingling one or more of the flows by setting at least one valve associated with each flow channel to a closed position one of an infinite number of flow capable positions.

BRIEF DESCRIPTION OF THE DRAWINGS

Referring now to the drawings wherein like elements are numbered alike in the several Figures

DETAILED DESCRIPTION

Figure 1:
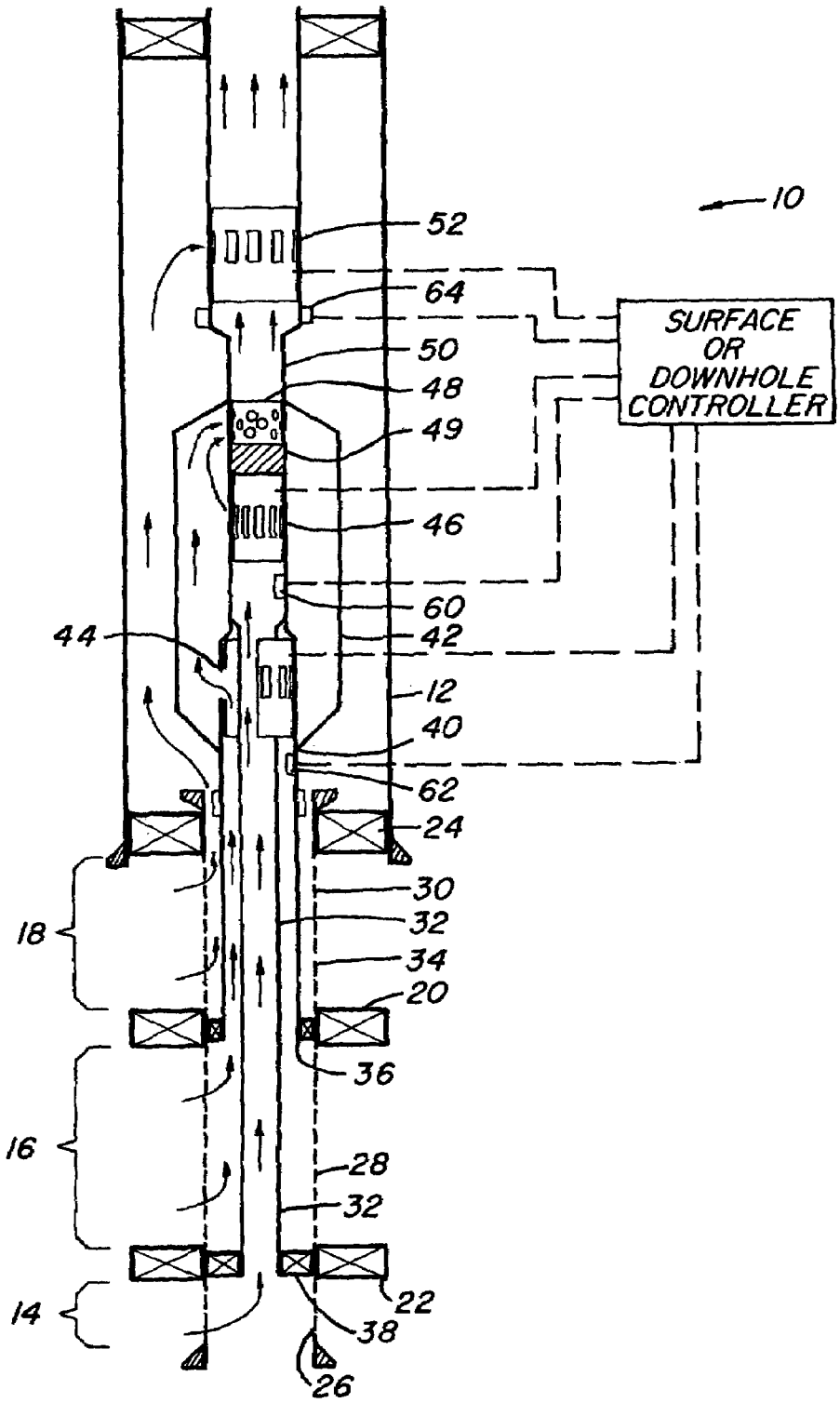
FIG. 1 is a schematic cross sectional view of a multiple zone downhole intelligent flow control valve system.

A multiple zone downhole intelligent flow control valve system is illustrated generally at 10 in FIG. 1. One of ordinary skill in the art will recognize the appearance of a well system wherein a section of the casing is illustrated at 12. Illustrated downhole of the casing section are three distinct production zones 14, 16 and 18, respectively. Each zone is schematically illustrated. The individual zones are delineated with packers 20, 22 and 24 as well as discrete screen sections 26, 28 and 30, although it should be understood that a single extended screen section could replace the individual screen sections without changing the function of the device. Extending downhole through the screen sections as identified are two pipes 32 and 34 of different lengths. It will be noted that pipe 32 is smaller than pipe 34 in diameter and is the pipe that extends farther downhole than pipe 34. Pipe 32 includes an annular packer 36 (or seal) which is nested with packer 20. Pipe 34 ends with a packer 38 (or seal) nested with packer 22. This, as is illustrated in the drawing, creates three individual flow channels for produced fluid. The fluid from zone 14 flows up the I.D. of pipe 32. The fluid produced from zone 16 flows through the annular space between pipe 32 and pipe 34 and the fluid produced from zone 18 flows in the annular space defined by pipe 34 and screen section 30. By so segregating the fluids, each zone of produced fluid enters the cased section 12 of the wellbore separated from each other fluid. Each of these fluids may then be controlled before commingling.

In order to provide control over all three fluid streams, three separate valves are supplied within the casing segment area 12. Extending radially outwardly from a seal 40 at pipe 34 is shroud 42. Shroud 42 is employed to maintain the fluid produced from zone 18 distinct from the fluids produced from zones 16 and 14. It will be understood that fluids from zones 14 and 16 are separate until and unless mixed in a space defined by shroud 42 by virtue of valves 44 (pipe 34) and 46 (pipe 32) being open. Within shroud 42, valve 44 is connected to pipe 34 to regulate fluid therefrom. Pipe 32 extends through the I.D. of valve 44 and up to a valve 46 which controls fluid production from zone 14 and pipe 32. Each valve 44 and 46, when open, dumps fluid into shroud 42 and through a holed pipe section (or a valve as desired) 48 (illustrated as holed pipe section). It will be appreciated by those skilled in the art that a plug 49 is installed in pipe 32 immediately uphole of valve 46 to prevent flow of fluid therepast in the lumen of pipe 32. Were it not for plug 49, pipe 32 would be contiguous with tubing 50.

Fluid flowing through holed pipe section 48 enters production tubing 50 to continue movement uphole. Fluid produced from zone 18 and moving through an annular space defined by shroud 42 at the inside dimension and by casing segment 12 at the outside dimension, moves through valve 52, if open, to join the fluid produced through holed pipe section 48. One of ordinary skill in the art will appreciate that valve 44 allows or prevents fluid production from zone 16, valve 46 allows or prevents production from zone 14 and valve 52 allows or prevents fluid production from zone 18. This is multizonal control where valve structures are maintained in a casing segment of larger diameter uphole of a gravel pack section. A well operator can therefore selectively close any or all of, and in each permutation thereof, valves 44, 46 and 52 to produce any combination of the flow streams including a single stream, a combination of streams or all or none of the streams emanating from the formation. Each of the valves as described above may be actuated hydraulically, pneumatically, electrically, mechanically, by combinations of the foregoing and by combinations including at least one of the foregoing etc. either by surface intervention or by intelligent systems in a downhole environment or uphole. Where intelligent completion systems are employed, at least one sensor would be installed (schematically illustrated as 60, 62 and 64) in each of the producing zones and in each of the valve sections such that parameters such as pressure, temperature, chemical constitution, water cut, pH, solid content, scale buildup, resistivity, and other parameters can be monitored by surface personnel or at least one controller whether surface or downhole controllers or both, (surface or downhole controller schematically illustrated in operable communication with sensors and valves) in order to appropriately modify the condition of the valves to produce the desired fluid. With appropriately programmed controllers, automatic adjustment of valves is possible and contemplated. It should also be noted that it is intended that each of the valves be variably actuatable such that pressure biases between the zones can be effectuated whereby water breakthrough can be avoided while maintaining production at an optimized level.

It should now be understood by one of ordinary skill in the relevant art, that the discussion of the apparatus/system above also presents a method for controlling the commingling of well fluids which was heretofore difficult if not impossible in certain well configurations such as multiple zone gravel packs. The method associated with the device described comprises physically containing the flows from different zones in concentrically arranged flow channels as discussed above. The flows are maintained separate until reaching a location where it is possible to valve them such that control is maintained. The method further comprises sensing the fluid parameters somewhere in the flow channel prior to reaching the valve structure in order to allow an operator or a controller to determine that a specific valve should stay closed or should be opened based upon a determination that the fluid being produced is not desired or desired, respectively. The process may be made automatic with appropriate programming for at least one controller.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A production control system comprising:

a series of nested tubular members wherein at least one axial flow channel and at least two annular flow channels are formed; and at least one valve configured and positioned downhole to control flow from each said flow channel.

2. A production control system as claimed in claim 1 wherein at least one valve is variably actuatable.

3. A production control system as claimed in claim 2 wherein each said valve is actuatable individually.

4. A production control system as claimed in claim 1 wherein said system further selectively joins flow from all said flow channels.

5. A production control system as claimed in claim 1 wherein said system further comprises at least one controller and at least one sensor, said at least one controller being in operable communication with said sensor.

6. A production control system as claimed in claim 5 wherein said controller is configured to operate said at least one valve automatically pursuant to information gained from said at least one sensor.

7. A production apparatus comprising:

a series of nested tubulars connected to one another such that at least an axial flow channel and at least two annular flow channels are formed;

a downhole valve associated with each of said flow channels configured and positioned to independently control flow from each of said flow channels.

8. A production apparatus as claimed in claim 7 wherein said apparatus further includes at least one sensor.

9. A production apparatus as claimed in claim 8 wherein said sensor senses at least one production fluid parameter.

10. A production apparatus as claimed in claim 9 wherein said parameter is selected from such as pressure temperature, chemical constitution, water cut, pH, solid content, scale buildup and resistivity.

11. A production apparatus as claimed in claim 8 wherein said apparatus further include a controller.

12. A production apparatus as claimed in claim 11 wherein the controller is located in the downhole environment.

* * * * *